United States Patent [19]

Shipman

[11] Patent Number: 4,775,144

[45] Date of Patent: Oct. 4, 1988

[54] ROTATABLE AND VERTICALLY OSCILLATABLE PASSENGER AMUSEMENT ASSEMBLY

[76] Inventor: Paul Shipman, 1013 W. Hickory Ave., Lompoc, Calif. 93436

[21] Appl. No.: 97,705

[22] Filed: Sep. 17, 1987

Related U.S. Application Data

[63] Continuation-in-part of Ser. No. 830,097, Feb. 2, 1986, abandoned.

[51] Int. Cl.[4] ..... A63G 31/00

[52] U.S. Cl. ..... 272/1 R; 272/6; 272/36; 272/50

[58] Field of Search ..... 272/1 R, 6, 7, 28 R, 272/29, 30, 36 1 C, 41, 40, 34, 36, 37, 43, 46, 48, 49, 50, 51; 280/400

[56] References Cited

U.S. PATENT DOCUMENTS

| | | | |
|---|---|---|---|
| 779,329 | 1/1905 | Thompson | 272/1 R |
| 813,953 | 2/1906 | Dalton | 272/50 |
| 1,073,970 | 9/1913 | Ernst | 272/50 |
| 1,439,478 | 12/1922 | Maynes | 272/28 R |
| 1,625,877 | 4/1927 | Wood et al. | 272/41 |
| 2,328,852 | 9/1943 | Shepherd | 272/36 |
| 2,456,648 | 12/1948 | Restall | 272/36 |
| 2,535,862 | 12/1950 | Pewitt | 272/36 |
| 2,547,152 | 4/1951 | Burg | 272/36 X |
| 3,066,935 | 12/1962 | Roberts | 272/51 X |
| 3,236,518 | 2/1966 | Wren | 272/50 |
| 3,653,657 | 4/1972 | Bishop | 272/51 X |

*Primary Examiner*—David A. Scherbel
*Assistant Examiner*—Richard E. Chilcot, Jr.
*Attorney, Agent, or Firm*—Howard L. Johnson

[57] ABSTRACT

A line of longitudinal rows of passenger compartments are swingingly connected between upstanding pairs of hydraulically rotatable screws by means of internally threaded roll-nuts. The line can be raised or lowered with the compartments disposed mutually level and/or axially tilted, by joint rotation of the screws. Each row can also be axially rotated, all in programmed sequence. Seat-restrained passengers are thus exposed to varied and unexpected motion which challenges normal equilibrium feelings. Basic assembly can be permanently mounted on flatbed trailer for highway or rail movement to successive carnival locations upon disassembly of segmented screws and telescopic support towers which hold up the assembled screws.

11 Claims, 7 Drawing Sheets

ROTATABLE AND VERTICALLY OSCILLATABLE PASSENGER AMUSEMENT ASSEMBLY

This is a continuation-in-part of my application Ser. No. 06/830,097, filed Feb. 2, 1986, now abandoned.

SUMMARY OF THE INVENTION:

This is a power-driven person-retaining amusement device formed of an end-to-end line of elongated, generally cylindrical passenger compartments or segments, with each compartment mounted on an individual platform carrying separate means for rotation of the segment (i.e. electric motor). Between the ends of adjacent compartments and at each end of a row, is an upstanding, segmented, elevation or suspension screw, power rotatable in either direction. Together with an adjacent pair of upright guide rods, each assembled screw is terminally supported by a telescopic tower. Each screw is driven by a hydrualic motor and carries a transversely extending, internally threaded collar or "rollnut" which by hinge joints is swingingly coupled to the edge of each adjacent platform. That is, for a line of four platform/segments there are five upstanding, individually rotatable suspension screws, each screw carrying an internally threaded,connector collar (rollnut) hangedly supporting an adjacent platform or pair of platforms. Such segment-length screws and gauged rollnuts are avilable articles of commerce used in mobile assemblies for warehousing, aircraft maintenance, and the like.

Thus, by simultaneous operation, five screws can raise and lower a whole line of four segments while they are held mutually level. Alternately, starting from a partially elevated level, the #2 and/or #4 screws alone can each raise or lower (only) the nearby edges of an adjacent pair of platforms (together with their passenger compartments) so as to tilt the paired platforms and compartments up or down, at opposite angles (like a V or an inverted V as the case may be). At the same time (or any other time), each compartment may be rotated by its independent drive motor, whether the platform is level, tilted, rising, descending or at rest. Accordingly a programmed sequence of such movements (intersperced with rest periods) may be followed for a time period for which a rider or party has paid or contracted for.

Each tower structure is telescopically contractable for transport and thence is extensible to an operational height comparable with the assembled suspension screw and its pair of guide rods, the latter being similarly length-segmented and separable for travel. Each pair of upstanding rods carries a generally rectangular stabilizer frame which is fixedly outstanding from the connector collar with vertically directed contact rollers held in rolling registration. Thus each platform and its passenger segment accommodates a varying longitudinal (axial) tilt caused by the respective rollnuts of a pair being supported at different heights by their respective elevating screws.

DETAILED DESCRIPTION OF PREFERRED EMBODIMENT

Figure 1:
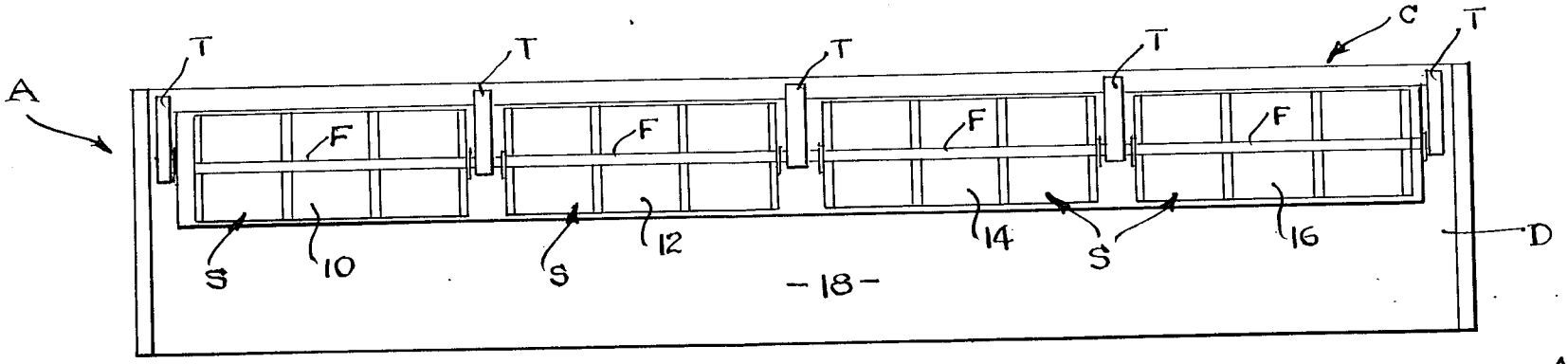
FIG. 1 is a top plan view of a towable highway vehicle with a four segment, passenger carrying carnival-type assembly permanently mounted thereon and shown in its collapsed form for travelling from one operational station to another.
Figure 2:
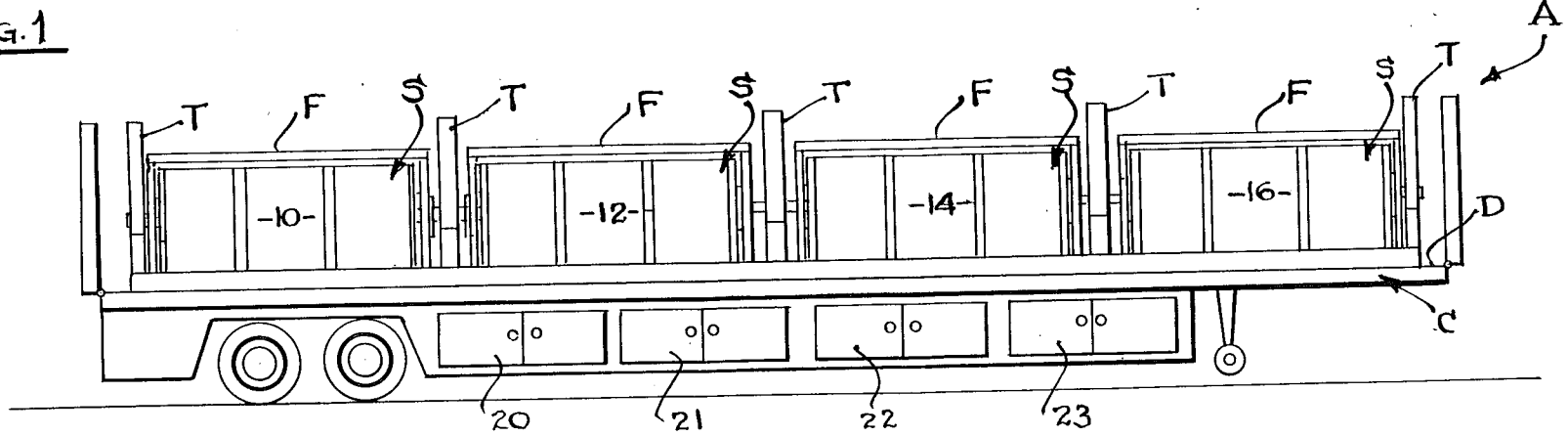
FIG. 2 is an elevational view of the vehicle and carried assembly as viewed from the near side of FIG. 1.
Figure 3:
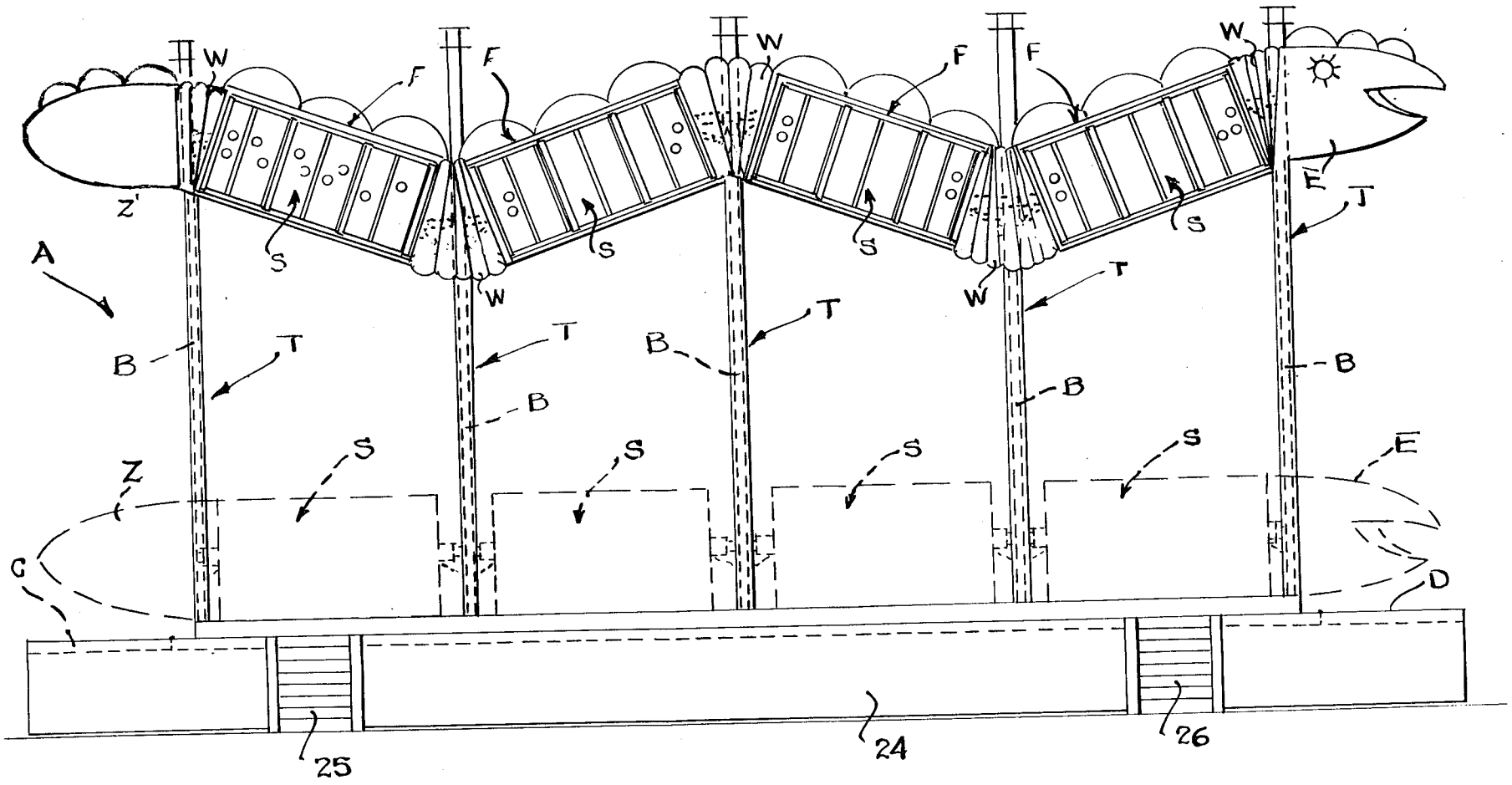
FIG. 3 is a side elevational view of the parked vehicle disposed in carnival operating position with the several end-coupled rotary passenger segments elevated to different heights so as to collectively resemble what might be fantasized as an articulated length of a sea-serpent or dragon, with a head and tail added and a temporary, longitudinal vehicle screening wall plus two rises of passenger access stairs located along the near side.
Figure 4:
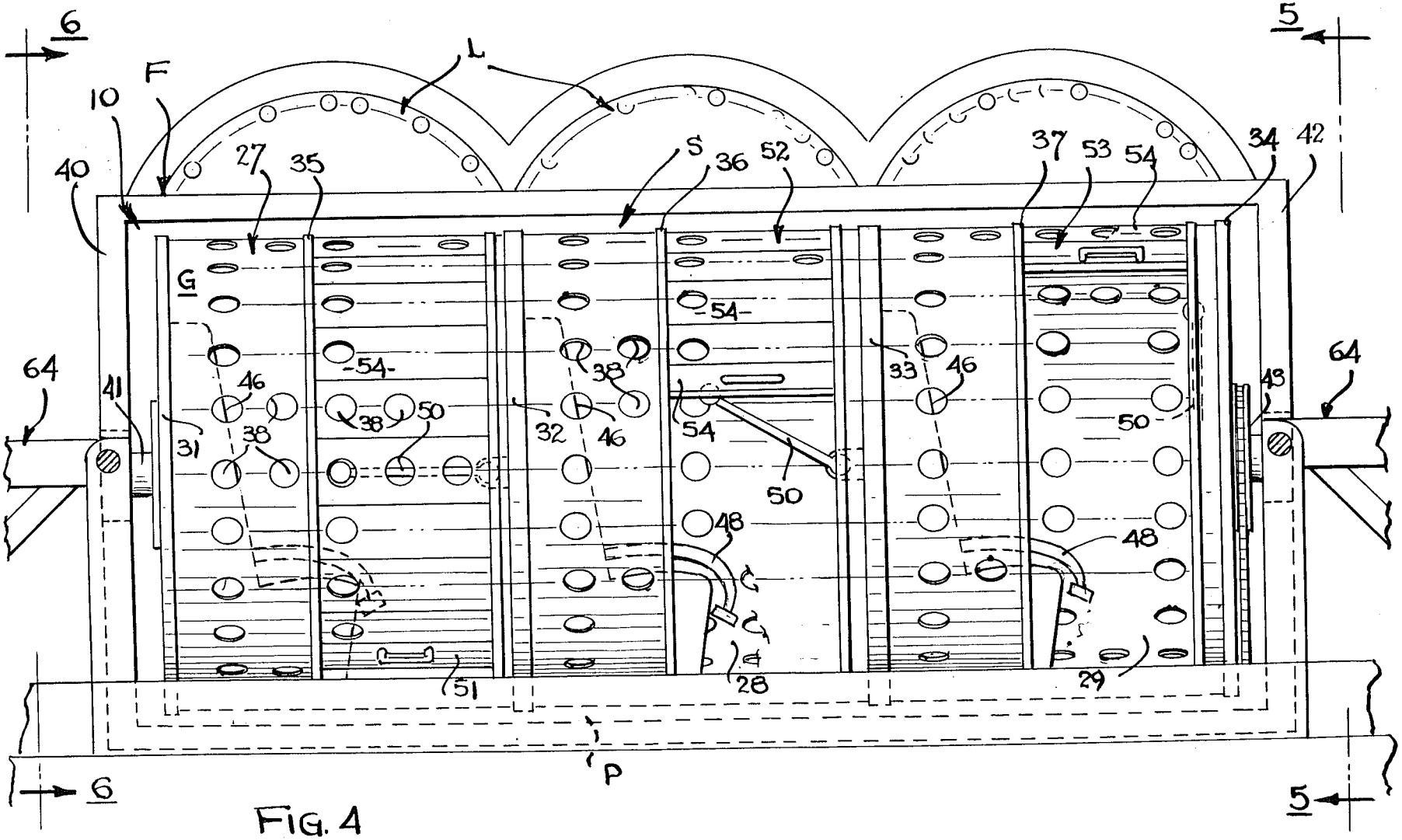
FIG. 4 is an enlarged, longitudinal elevational view of three passenger units of a segment which is generally covered with viewing apertures, only some of which are shown.

As seen particularly in FIGS. 1-3, the assembly A is secured lengthwise upon approximately half of the width of a flatbed or loading deck D of a wheeled carriage C. The latter may be part of a highway vehicle or railroad car as transport need may direct. The other longitudinal half 18 of the deck thus serves as a passenger walkway giving access to the individual segments at times of operation such as at successive carnival stops. The segments also provide limited transit storage for miscellaneous cargo during traveling. Further storage chambers are located beneath the mounting deck D with access by closures 20, 21, 22, 23. At operational stops, the entry to this side of the undercarridge is blocked or concealed by an upstanding length of opaque curtain or screening material 24 and by placement of short flights of stairs 25, 26 which may be temporarily coupled thereto. Other decorative accessories such as the fans with arcuate lights L (FIG. 4), serpent's head E, tail Z, and accordian pleats W are carried in storage and attached to the segment body for the period of operation.

Each segment (10, FIG. 4) is constructed of a lengthwise disposed, cylindrical shell S, divided into three passenger compartments 27, 28, 29 by transversely disposed solid disks 31, 32, 33, 34, and intermediate reinforcing hoop members 35, 36, 37, which disks and hoops jointly form a composite, reinforced guard body G. The latter is characterized by a continuous pattern of spaced apertures 38, having a minimum diameter of approximately two inches, by which a rider can continuously view the exterior scene as the cylinder is moved. Each segment 10 is mounted on a generally planar, rectangular platform P which supports a three sided, elongated frame F of which the respective end members 40, 42 are fixedly upstanding from the deck D and journal corresponding end shafts 41, 43 of the cylindrical body G. A reversible electric motor M2 carried by the platform P is drive connected to the shaft 43 by a drive gear 44 and chain 45 by means of which each particular segment may be selectively rocked an arcuate amount (e.g. 46° in each direction) for a desired length of time, and/or continuously rotated for a period.

Each compartment 27, 28, 29 is provided with a diametrically directed seat 46 of a size to accommodate, typically, two passengers with the riders' backs rested against a crosswall 31, 32, 33, plus adequate restraining belt or harness 48 and transverse handle or grab bar 50. Forward from the seating area, each compartment has a circumferentially curved, sliding closure 51, 52, 53 formed of lateral, edge-linked, cross panels 54 with their ends slidable in respective grooves or tracks. The panels continue the pattern of spaced, view apertures.

Intermediate each segment 10, 12, 14, 16 and at each end of the row of segments is an upstanding, rotary, suspension screw B of the type used to move high speed passenger elevators; that is, a total of five screws for the illustrated four segment assembly. With a double seat 46 in each of the twelve compartments, such assembly can raise and lower a total of 24 persons simultaneously, and at the same time, or in the absence of vertical movement, each segment (carrying six persons) can be individually rotated, or rocked, as may be desired (by the operator). The top of each screw B is pivotally supported for axial rotation by a telescopic tower T which includes a rear upstanding pillar or stanchion 56 supporting an anchoring crosshead of transverse members 59, 61. The crosshead also provides top anchorage for a cylindrical pair of segmented guide rods 57, 58 disposed mutually parallel, one on each side of each screw B.

Each of the guide rods of a pair carries a short, upstanding, rectangular, roller-carrying tube 62, 63, which guide tubes plus an internally threaded collar 65 are fixedly carried by a generally rectangular, outwardly embracing, stabilizing yoke or frame K from which pairs of suspension arms 64, connects to adjacent edges of each platform P. The collar 65 threadedly disposed on the screw, acts as a non-rotating nut ("roll-nut") and accordingly moves linearly up and down in response to rotation of the screw B, while it is kept from binding by the connector assembly or stabilizing frame K, and in particular by the guide tubes 62, 63, each with dual rows of four contact rollers n.

Each elevator or suspension screw B is driven by a hydraulic motor H, which is supplied with pressurized hydraulic fluid through inlet pipes 101 and 102 from a pump P driven by an electric motor M. Return pipes 103 carry the fluid back to a reservoir 104, from which it goes to the pump P. Inlet pipes 101 supply fluid to drive the motor H in one direction to cause a fluid connected, internally threaded collar 65 to rise, while inlet pipes 102 drive the motor H in the opposite direction to cause a connected collar 65 to descend. Thus an adjacent pair of threaded collars 65 (connected to the same segment S) may be simultaneously rotated in the same direction (e.g. both clockwise or both counterclockwise) to raise or lower a level-held segment as may be desired. Alternately, to tilt a dual-suspended segment, one need only raise or lower a single collar the required amount (and reverse the rotational direction to restore to level condition the tilted segments). In addition, alternate ends of a segment may be tilted sequentially so as to give the riders the sensation of continued stepwise elevation or drop of the segment (while in addition, simultaneously rotating it on its axis, if desired).

Inlet pipes 101 and 102 for elevator screws #2 and #4 are connected to an electrically-actuated distributing valve 105, while inlet pipes 101 and 102 for elevator screws #1, #3, #5 are connected to an electrically-actuated distributing valve 106. Valve 105 is controlled by two relays 107 and 108, which are energized by current through wires 109 and 110, respectively, going to the output terminals 111 of a master controller or computer Q.

Valve 106 is controlled by two relays 113 and 114, which are energized by current through wires 115 and 116, respectively, going to the output terminals 111 of the computer Q. When relay 107 is energized, valve 105 sends hydraulic fluid through inlet pipes 101 to the motorsH of elevator screws #2 and #4, causing each connected collar 65 to rise. When relay 108 is energized, valve 105 sends hydraulic fluid though inlet pipes 102 to the motors H of elevator screws #2 and #4, reversing the direction of rotation. Return fluid goes from the motors H through return pipes 103 to the reservoir 104. At the same time that relay 107 is energized to raise collars 65 on screws #2 and #4, relay 114 is energized, causing valve 106 to send hydraulic fluid through inlet pipes 102 to the motors H of elevator screws #1, #3, #5, causing their respective collars 65 to descend. In like manner, when relay 108 is energized to lower collars 65 on screws #2 and #4, relay 113 is energized, causing valve 106 to send hydraulic fluid through inlet pipes 101 to the motors H of elevator screws #1, #3,#5, causing their respective collars 65 to rise. Again, spent fluid is returned via pipes 103 to the reservoir 104. Thus, collars 65 of screws #2 and #4 are rising, while collars 65 of screws #1, #3,#5 are descending and vice versa.

The computer Q is a programmable controller of the type utilizing software that responds to certain inputs, including a built-in time (not shown) to control the several electro-mechanical devices that operate the device of the invention for a predetermined period of time, such as two minutes for example. A General Electric "Series One Junior" Programmable Controller has been found satisfactory for the present usage.

Figure 5:
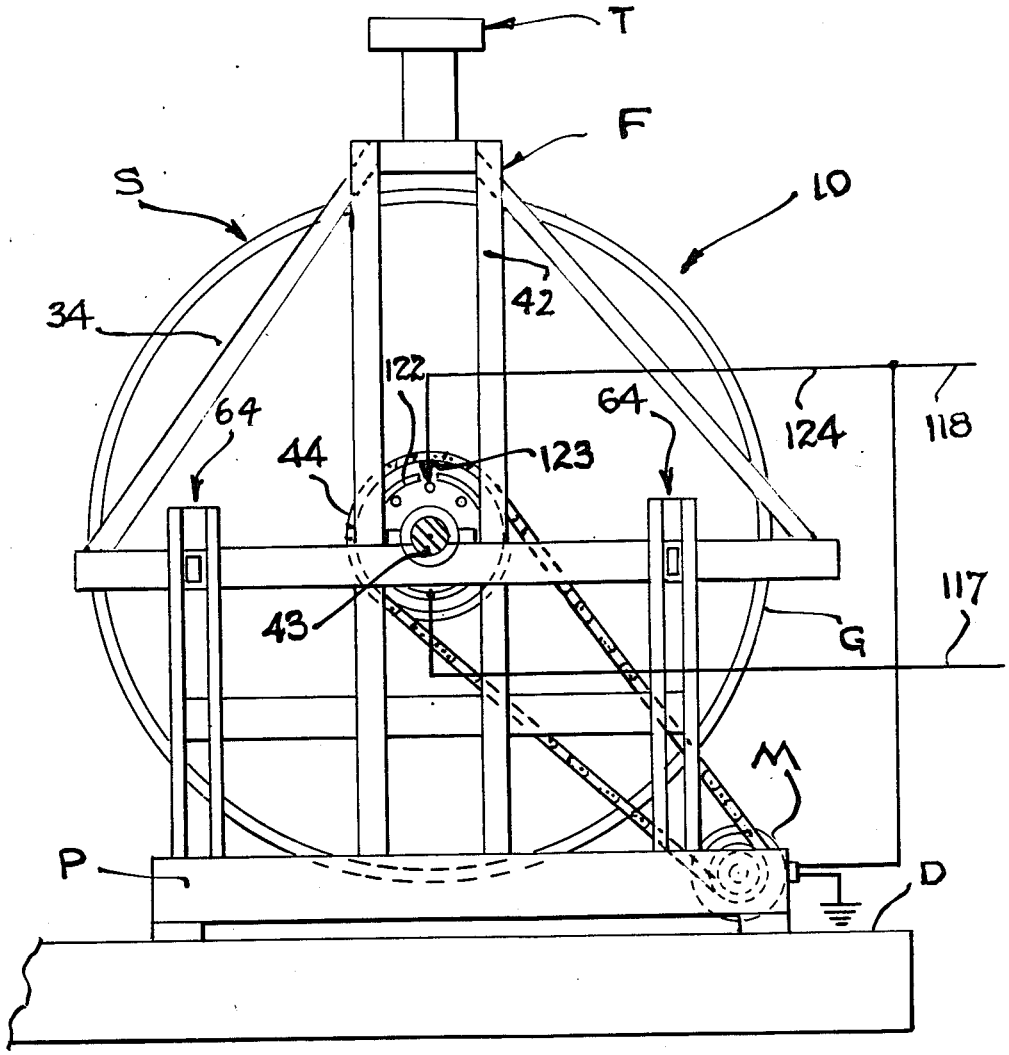
FIG. 5 is an end elevational view of a segment with a horizontal row of rotatable passenger units as seen along line 5—5 of FIG. 4.
Figure 9:
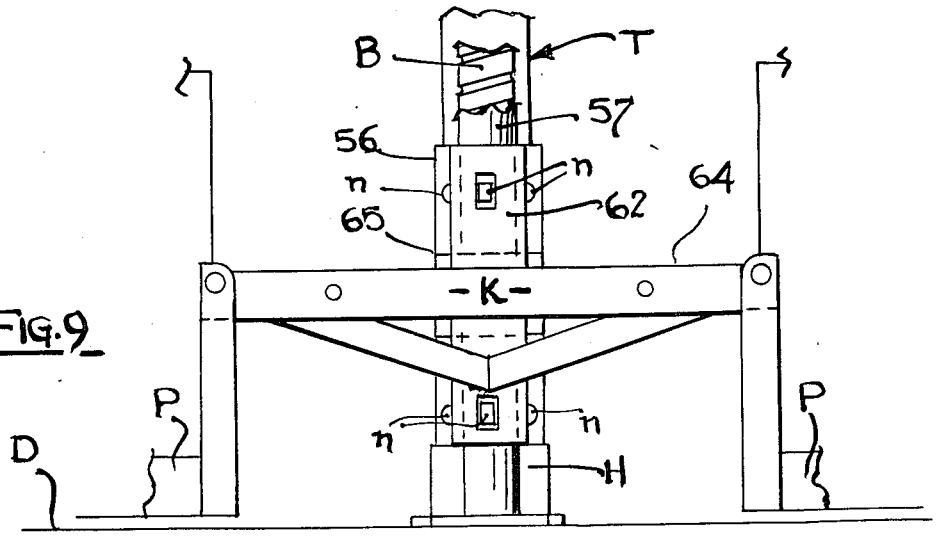
FIG. 9 is an elevational view, partly broken away, as seen along the line 9—9 of FIG. 7, particularly showing the connection of the stabilizing yoke to the adjacent platform.
Figure 6:
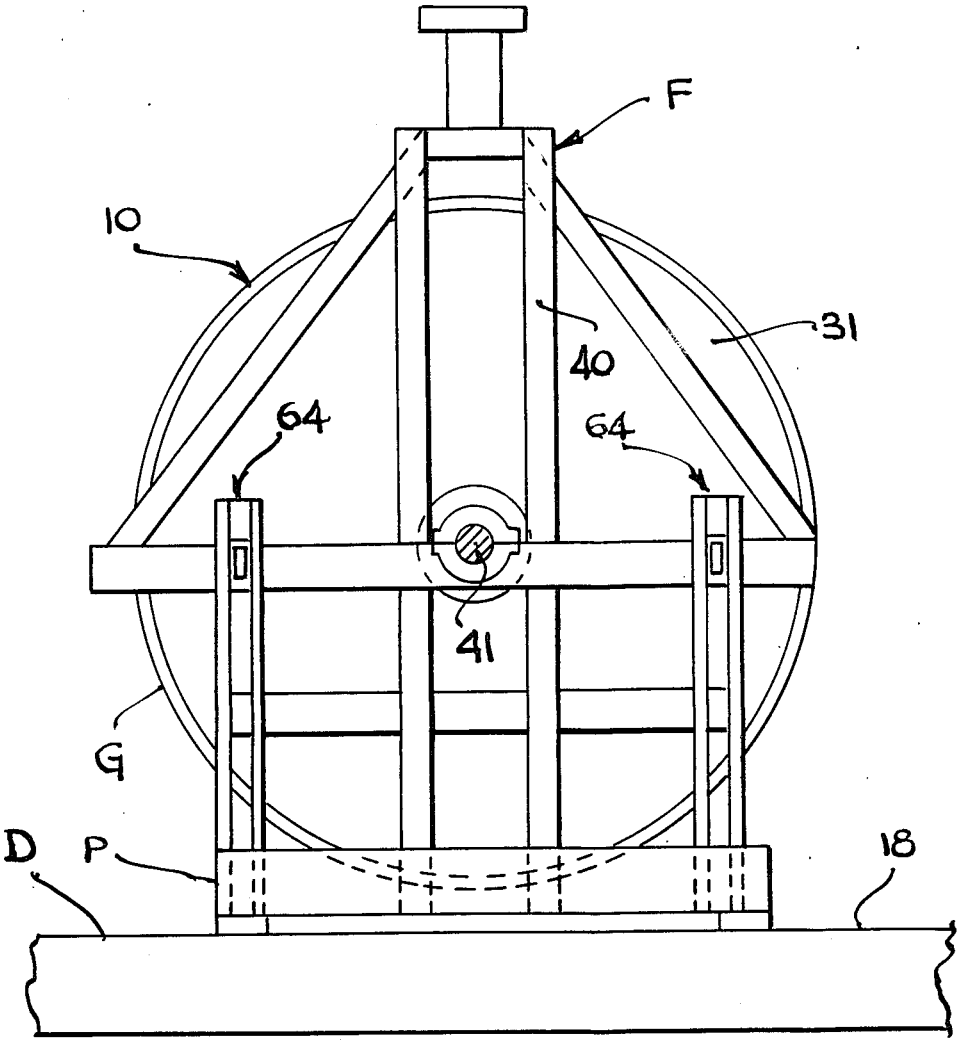
FIG. 6 is an elevational view of the opposite end of the segment of FIG. 5.
Figure 7:
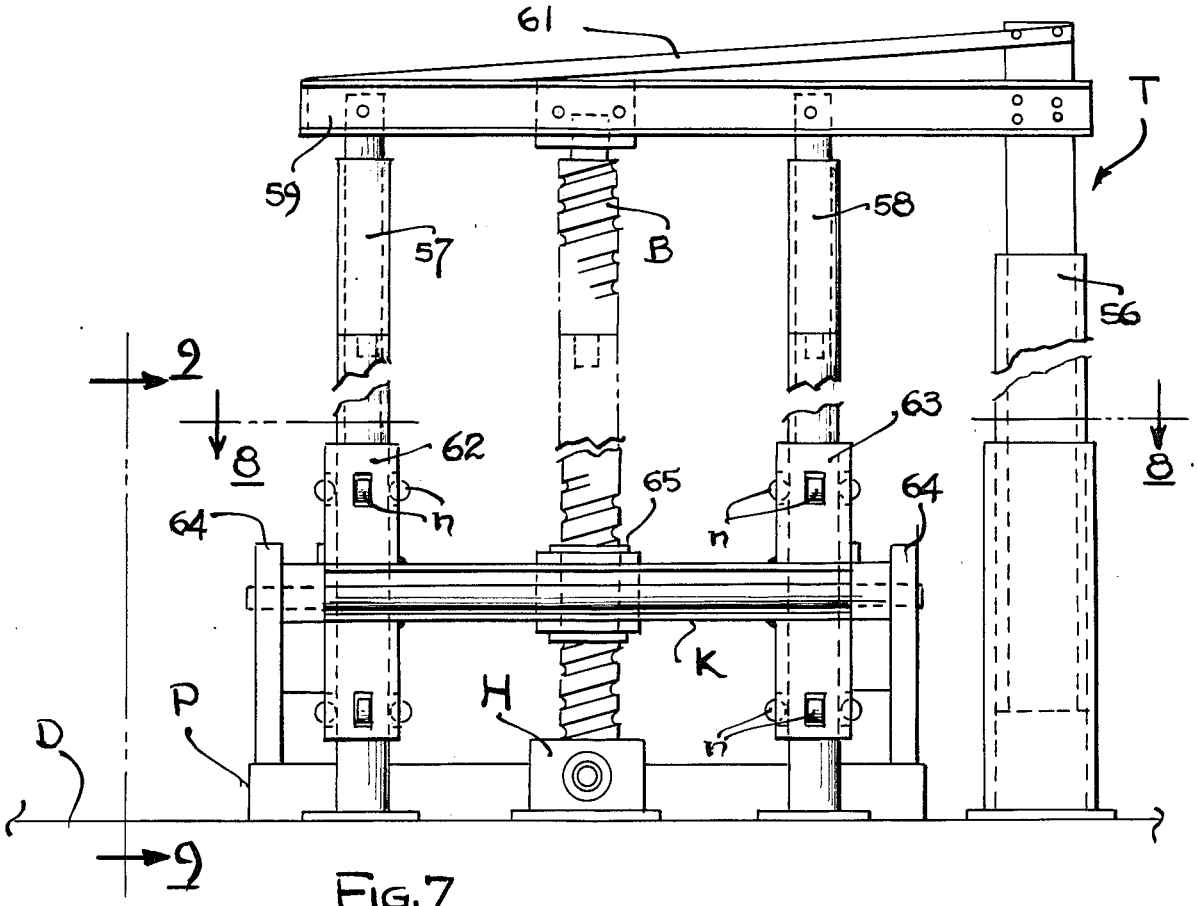
FIG. 7 is an elevational view, foreshortened, of one of the cluster of support elements comprising a telescopic support tower, an elevator screw, pair of parallel guide rods and stabilizing yoke of the assembly.
Figure 8:
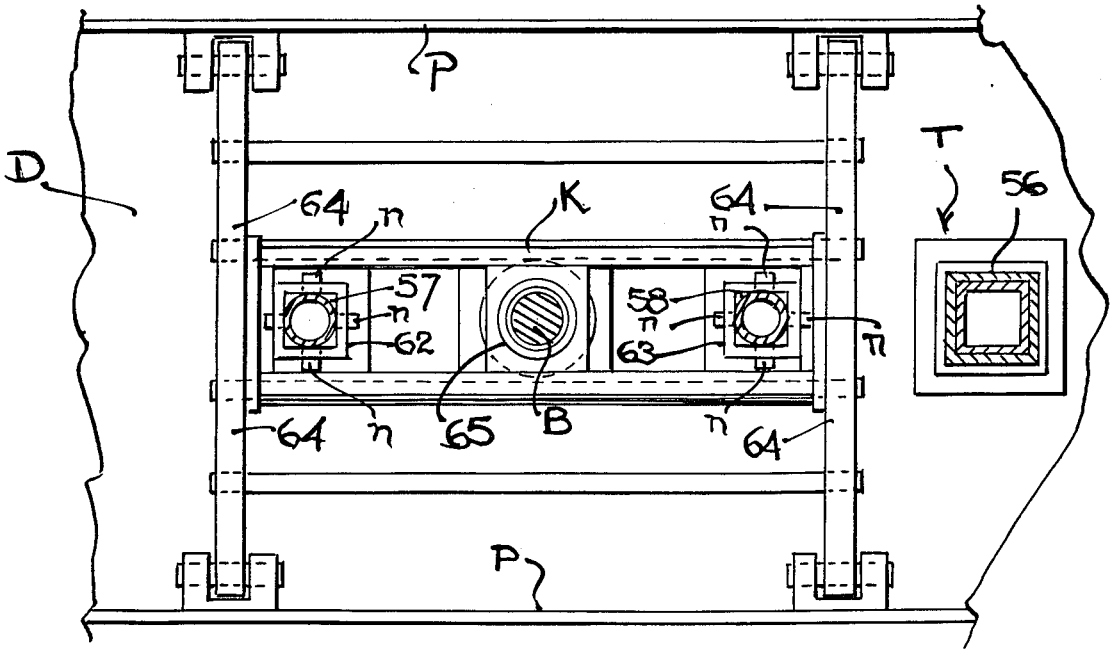
FIG. 8 is a transverse sectional view taken along line 8—8 of FIG. 7.
Figure 10:
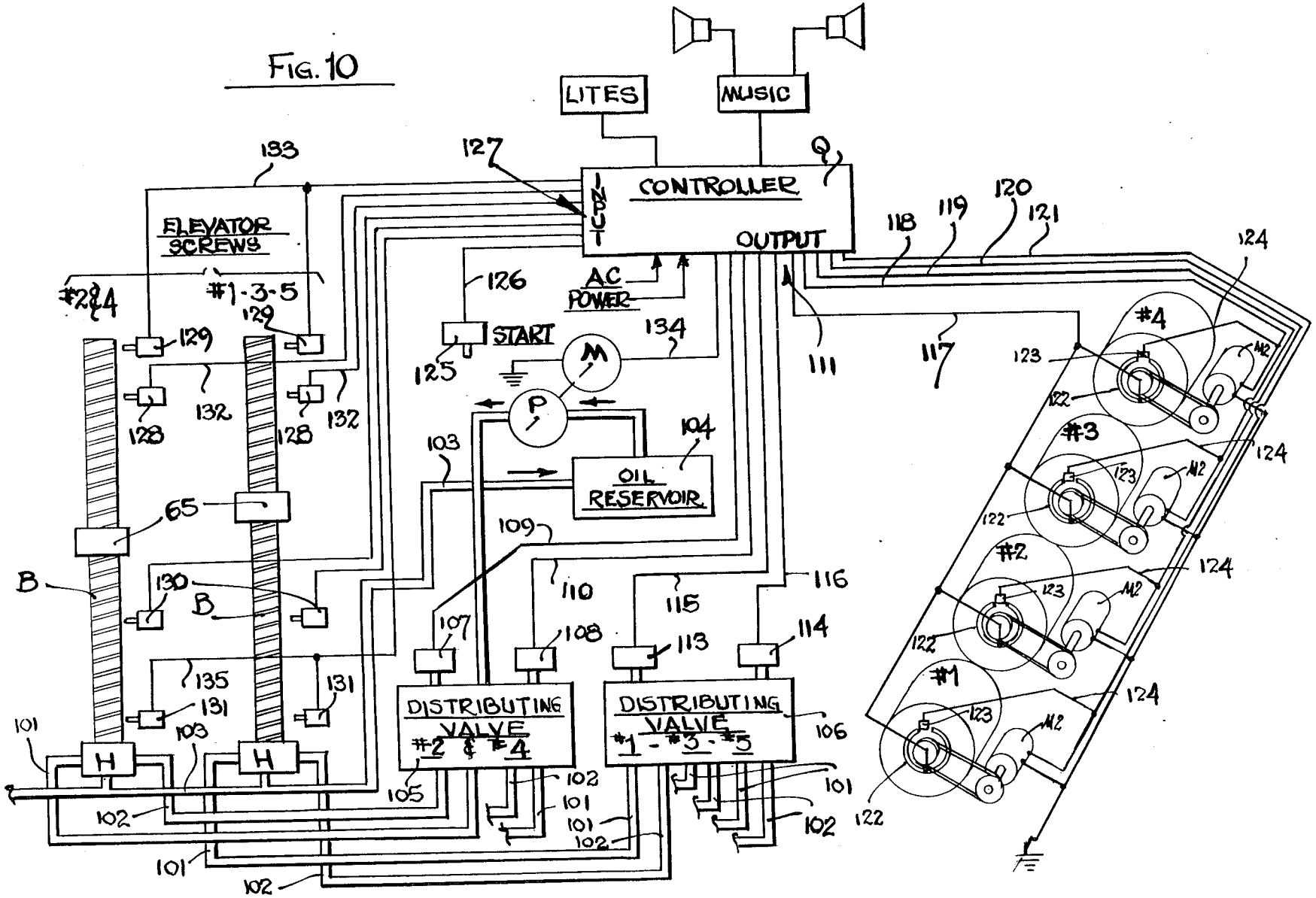
FIG. 10 is a schematic diagram of the hydraulic system and associated operating or control elements of the assembly, the passenger segments and elevating screws being spacially separated for greater clarity.

In addition to controlling the valves 105 and 106, the computer Q also controls the operation of motors M2 that rotate the individual segments S about their respective axes, alternately reversing the direction of rotation and varying the speed of rotation. To accomplish this, the computer has output electrical lines 117, 118, 119, 120 and 121 connected to the output terminal 111 of the computer and going to the respective motors M2. Each of the lines 118, 119, 120, and 120 goes directly to the one motor M2 with which it is associated, while line 117 supplies current to a split slip-ring 122 mounted on the axis of each of the segments S so as to rotate therewith, as best shown in FIG. 5. A control brush 123 wipes on the slip-ring 122 and is connected by a wire 124 to the motor M2 driving that segment. Wires 118, 119, 120 and 121 provide current to the motors M2 during the two minute operation of the device, while wire 117 remains dead. At the conclusion of the two minutes of operation, the screws B lower the segments to the platform P, and when the segments reach a predetermined level, such as 6 ft. above the platform, the computer Q switches the current from wires 118, 119, 120 and 121 to wire 117. Current for the motors M2 now goes to the split slip-ring 122, contact 123 and connecting wire 124, causing the motor to continue running until the contact 123 comes to the opening in the split slip-ring 122, at which point the circuit is opened and motor M2 stops running. The location of the opening in the split slip ring is such that the motor M2 stops when the segment S is upright (loading position) so that carried passengers can readily exit from their compartments.

The controller Q is actuated by input signals that come from various switches, which will now be described. The entire two minute program is initiated by pressing a start button 125 which is connected by a wire 126 to one of the input terminals 127. Mounted on suitable structure alongside each of the elevator screws B are four vertically spaced contact switches 128, 129, 130 and 131, which are adapted to be engaged and closed by the collar 65 as the latter rises or descends. Each of the switches 128 is located about 24 feet above the platform P, and when the collar 65 reaches that level, a signal is sent along wire 132 to the associated input terminal 127, causing the regularly programmed operation of hydraulic motors H and segment-rotating motors M to begin. In the event that due to some malfunctioning of the system, the elevator screws B should continue to elevate the collars 65, the latter will close switches 129, which is a safety limit switch, and this shuts down the entire operation of the device until the malfunction can be corrected. Limit switch 129 is connected by wire 133 to one of the input terminals 127 on the computer. When switch 129 is closed, the circuit to line 134 going to motor M is opened, and this shuts down the motor, causing the screws B to stop turning.

At the conclusion of the two minute operation of the device, the hydraulic motors H are operated in a manner to bring all of the segments S to a level condition or loading position while they are being lowered to the platform P. As the collars 65 descend past the switches 130, the switches are closed, and this causes the computer Q to switch the current from wires 118, 119, 120 and 121 to wire 117, so that motors M2 are caused to continue running until contact 123 comes to the opening in split slip-ring 122, at which point the motors M2 are stopped and segments S are upright.

As the collars 65 finally reach the platform P, switch 131 is closed, sending a signal via wire 135 to the computer Q to shut down the entire system. The passengers may then exit from their regulation compartments, and the device is ready for its next run.

It will be appreciated that the motion of the device and especially its change of direction present a challenge to the rider's sense of equilibrium and his physiological ability to respond or accommodate. Recorded music and flashing lights may be synchronized with the movement of the compartments to contribute to the fantasy of the setting. Decorative features may suggest that the segments constitute body cavities of a dragon or sea monster. However usage of the assembly need not be limited to carnival rides, whether "scary" or not. It may be used as a flight simulator to test aviators or astronauts and can also be used to test package stability of articles as prepared for shipping or rapid transit. Thus a pair of such platform-mounted test segments may be permanently mounted in any edifice and operated with the minnimum of three elevating screws. They may be used to test persons or parcels on a "non-amusement" basis.

I claim:

1. An equilibrium affecting assembly adapted to effect abrupt vertical, rotational and tilting change of a rider's position when carried in an enclosure thereof, said assembly comprising in combination, a longitudinal row of end-to-end disposed, individually rotatable segments, said row being formed of at least an adjacent pair of said segments, each segment forming an enclosure having internal support means for restraining a rider contained therein and thus held against potential injury from a total of movements which may be imparted to a particular segment, platform means individually supporting each of said segments and means for selectively rotating each of said segments relative to said platform means, a power-rotatable suspension screw disposed upstanding between each segment of said row and adjacent the outer ends of the row, each suspension screw functionally carrying an internally threaded collar having hinged support means connecting said collar to at least one adjacent segment, and operating means for jointly rotating all of said screws for raising and lowering said segments while the latter are disposed level and alternately for raising and lowering adjacent ends of said adjacent pair of segments by selective rotation of one of said screws which is upstanding between the pair of segments so as jointly to tilt said last segments in opposite directions.

2. An assembly according to claim 1 which includes a structural tower terminally supporting each of said suspension screws, and a pair of upstanding guide rods disposed generally parallel to each of said screws, one on each side thereof, and a stabilizing yoke fixedly secured to and outwardly surrounding each said threaded collar and its pair of guide rods, said yoke having roller guide means disposed in functional contact with said pair of rods whereby said threaded collar is prevented from binding in movement along said suspension screw.

3. An assembly according to claim 1 which is fixedly mounted on a wheeled carriage adapted for movement along a public highway and the like between one operational station and another.

4. An assembly according to claim 3 wherein the fixedly mounted assembly is disposed along a lengthwise partial width of said carriage, whereby a laterally adjacent lengthwise remaining width forms a passenger walkway giving access to said segments.

5. An assembly according to claim 1 wherein said rotatable segments are provided with a surrounding guard shell formed with a covering pattern of visual apertures through which a rider may view the changing exterior when riding within the moving segment.

6. An assembly according to claim 1 wherein said rotating means is directionally reversible and includes means for selectively rocking said segment an arcuate amount.

7. An assembly according to claim 2 which is fixedly mounted wheeled carriage adapted for movement along a public highway and the like between one operational station and another and said structural tower is formed of telescopic segments.

8. An assembly according to claim 2 wherein said structural tower is formed of telescopic segments.

9. An equilibrium affecting assembly adapted to effect abrupt vertical, rotational and tilting change of a rider's position when carried in an enclosure thereof, said assembly comprising in combination, a longitudinal row of end-to-end disposed, individually rotatable segments, each segment forming an enclosure having internal support means for restraining a rider contained therein and thus held against potential injury from a total of movements which may be imparted to a particular segment, each of said rotatable segments being mounted on a platform having means for selective rotation of the segment, a power-rotatable suspension screw disposed upstanding between each segment of said row and adjacent the outer ends of the row, a structural tower terminally supporting each of said suspension screws and including a pair of upstanding guide rods disposed generally parallel to each of said screws, one on each side thereof, each suspension screw functionally carrying an internally threaded collar plus support arms connecting said collar to said platforms which are immediately adjacent thereto, a stabilizing yoke fixedly secured to each of said threaded collars, disposed outwardly surrounding a suspension screw and having roller guide means disposed in functional contact with said pair or rods whereby the threaded collar is prevented from binding in movement along said suspension screw, and operating means for jointly rotating all of said screws for raising and lowering said row of segments while they are disposed level, and alternately for raising and lowering adjacent ends of each of said platforms so as jointly to tilt the carried pair of segments in opposite directions.

10. An assembly according to claim 9 which is fixedly mounted on a wheeled carriage adapted for movement along a public highway and the like between one operational station and another.

11. An amusement apparatus comprising a plurality of hollow passenger-carrying segments arranged end-to-end to form an elongated axially rotatable assembly, said segments being joined together at their central axes by flexible connector means permitting vertical swinging movement of the segments relative to one another, and each of said segments being individually rotatable about its central axis from an initial passenger loading position, vertical elevator screws positioned between adjoining pairs of segments and at the outer end of each segment, said screws each having a collar disposed in threaded engagement therewith, and said collars being connected to said assembly of segments adjacent said connector means and at the outer ends of the end segments, motor means for rotating said elevator screws in either direction so as to raise or lower said collars, other motor means for rotating said segments about their central axes, a plurality of sensors adjacent certain of said elevator screws at various vertical elevations, said sensors being responsive to proximity of said collar as the collar ascends and descends an elevator screw, and control means responsive to a signal from one of said sensors when said collar reaches a predetermined elevation to activate said motor means of alternate elevator screws first in one direction and then the other, while at the same time said motor means of the intermediate elevator screws is driven in the opposite direction, causing said assembly of segments to undulate in a serpentine manner, said control means also activating said other motor means to individually rotate said segments in one direction or the other, said control means being operable after a selected period of operation to cause said elevator screws to lower the assembly of segments and to operate said other motor means responsive to a signal from another of said sensors to bring all of the segments to a passenger unloading position.

* * * * *